United States Patent [19]

Meyer

[11] 4,407,559

[45] Oct. 4, 1983

[54] CONNECTOR DEVICE WITH FLUSH MOUNTING RECEPTACLE, COVER PLATE AND TERMINAL BOARD

[75] Inventor: Daniel Meyer, Rochester, Minn.

[73] Assignee: Communications Systems, Inc., Hector, Minn.

[21] Appl. No.: 252,287

[22] Filed: Apr. 9, 1981

[51] Int. Cl.[3] ..... H01R 13/514

[52] U.S. Cl. ..... 339/126 R; 339/176 M; 179/178

[58] Field of Search ..... 339/125, 126 R, 176 M; 179/1 PC

[56] References Cited

U.S. PATENT DOCUMENTS

| | | | |
|---|---|---|---|
| 3,668,324 | 6/1972 | Firestone | 179/1 PC |
| 3,850,497 | 11/1974 | Krumreich et al. | 339/176 M X |
| 4,040,699 | 8/1977 | Rasmussen | 339/126 R X |
| 4,050,768 | 9/1977 | Gumb | 179/1 PC |
| 4,221,458 | 9/1980 | Hughes et al. | 339/126 |

OTHER PUBLICATIONS

Advertisement, Crest Industries, Inc., Telephony 7-1-6-79, p. 70.

*Primary Examiner*—Eugene F. Desmond
*Attorney, Agent, or Firm*—Kinney, Lange, Braddock, Westman and Fairbairn

[57] ABSTRACT

A connector device, for use in a communication system, that receives an electrical communication plug is mounted on a surface such as a wall. The device includes a cover plate having at least one opening and a periphery on a rear side that is mounted flush with screws against the wall. At least one receptacle is attached adjacently to the rear side of the cover plate and has an insulated housing with a communication plug receiving end. The plug receiving end is aligned with the opening and is substantially in the same plane as the cover plate for receiving the plug. A rear end of the receptacle extends into a cavity in the wall. The plug receiving end includes a plurality of spaced apart conductive spring-type contacts, each conductive spring-type contact conductively contacts a corresponding electrical conductor within the plug when the plug is inserted into the plug receiving end. A plurality of wires extend from the rear end of the receptacle and are conductively connected to the spring-type contacts. A terminal board is positioned on the rear side of the cover plate and has a plurality of conductive terminals on a base which are conductively connected to the wires extending from the rearward end of the receptacle and to a plurality of wires conductively connected to the communication system. The terminal board has a plurality of supports projecting towards the cover plate spatially supporting the base from the rear side of the cover plate.

10 Claims, 6 Drawing Figures

CONNECTOR DEVICE WITH FLUSH MOUNTING RECEPTACLE, COVER PLATE AND TERMINAL BOARD

BACKGROUND OF THE INVENTION

1. Field of the Invention

The present invention relates to connector devices that have communication receptacles mounted therein. In particular, the present invention relates to communication receptacles that are flush mounted on a surface such as a wall.

2. Description of the Prior Art

Communication receptacles, such as the one shown in the Hughes et al U.S. Pat. No. 4,221,458, are installed in walls or on panel boards of various communication equipment to be used as connectors in a communication system. The receptacle has a housing which is placed within a cavity in the wall surface and a plug receiving end which is positioned proximate the plane of the wall surface. The receptacle is typically positioned in at least two known methods.

In the first method, the receptacle snaps into grooves or the like located on the edge of the cavity, as shown in the Hughes et al patent. This method required the edge of the cavity to fit precisely around the housing of the receptacle to cover the opening of the cavity and hold the receptacle.

In the second method, the receptacle is fixed to a flat metal framework that extends across the cavity. The metal framework is typically attached to an electrical box in the cavity. The metal framework has holes which are aligned with threaded holes in the electrical box. The framework is then attached to the electrical box by screws extending through the holes in the metal framework and threadably engaging the threaded holes in the electrical box. The receptacle is generally attached to the metal framework by a snap connection. A cover plate with a receptacle opening is attached to the metal framework with screws. The plug receiving end of the receptacle extends through the opening and the cover plate hides the cavity from view. The second method has the disadvantage of three separate components that need to be aligned and attached to each other to install the receptacle.

Terminals are sometimes included on the rear side of the receptacle for conductively connecting the receptacle to wires which are conductively connected to the communication system. Since the receptacle is typically small, only a limited number of terminal posts, generally four, can possibly be included on the back of the receptacle, limiting the number of conductive connections to the receptacle. In other situations, the receptacle has no terminals, but has electrical wires running from the back of the receptacle that are sufficiently long enough to be conductively connected to a central terminal board in the communication system. The wires extending from the receptacle must be of sufficient length to reach the central terminal board. Thus, the receptacle has to have wires of sufficient length to fit most applications or its application is limited.

SUMMARY OF THE INVENTION

The present invention includes a connector device for use in a communication system that mounts on a surface, such as a wall, for receiving an electrical communication plug. The device includes a cover plate having at least one opening therethrough and a periphery on a rear side which abuts the wall. Screws are used to mount the cover plate to the wall. At least one receptacle housing is attached adjacent to the rear side of the cover plate. The receptacle is found in an insulated housing with a plug receiving end that is aligned for cooperation with the opening of the cover plate and a rearward end which extends into a cavity within the wall. The receptacle has a plurality of spaced apart spring-type contacts for conductive contact with corresponding electrical connectors in the plug. A plurality of wires extend from the rearward end of the receptacle. A terminal board is positioned on the rear side of the cover plate and is spaced from the cover plate by a plurality of supports. The terminal board has a plurality of terminals for connection with the wires of the receptacle and with wires of the communications system.

The connector device permits mounting of the communication receptacle in an easy and efficient manner by simply positioning the cover plate over a cavity and attaching the cover plate to the surface of the wall near the cavity or to an electrical box in the cavity. In addition the plurality of conductive terminals permit simple and readily accessible conductive connection between a communication system and a receptacle having a large number of communication lines.

DETAILED DESCRIPTION OF THE PREFERRED EMBODIMENTS

Figure 1:
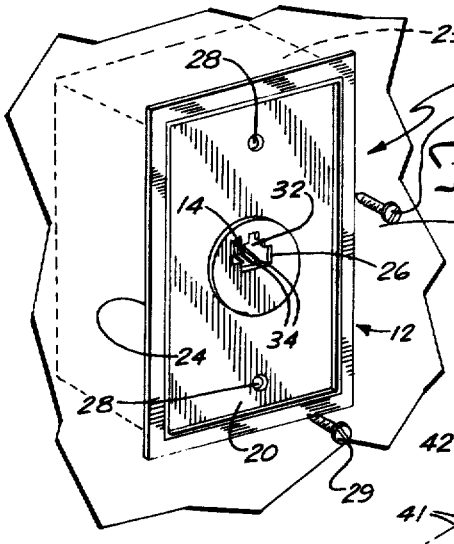
FIG. 1 is a perspective view of the connector device of the present invention having one receptacle.
Figure 2:
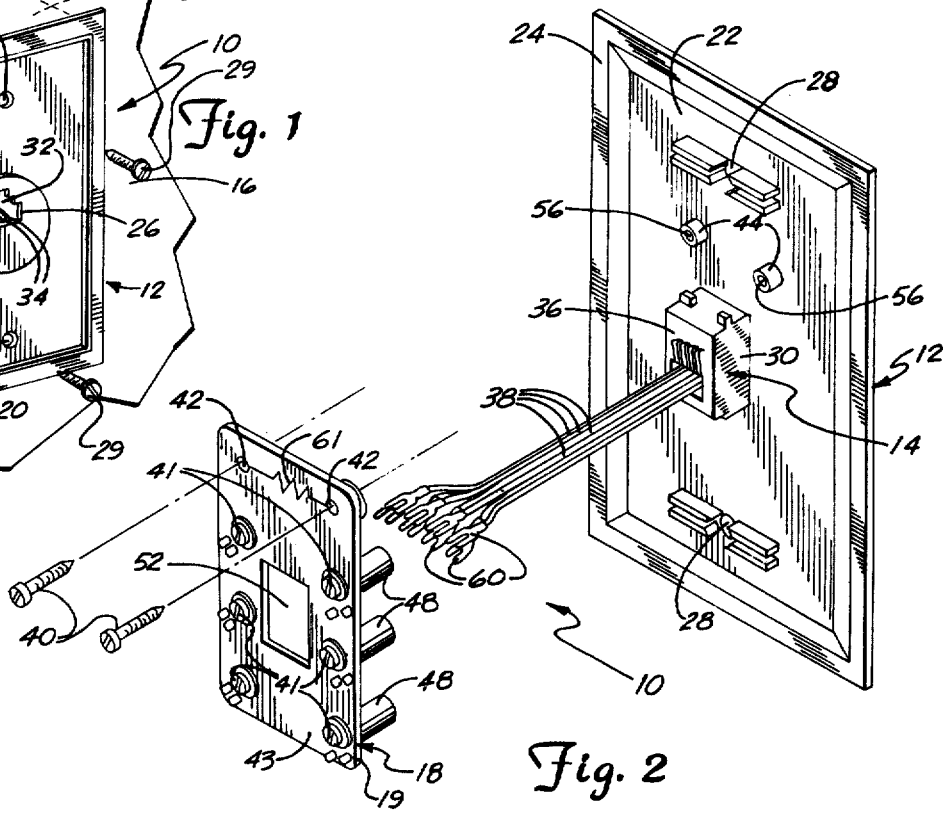
FIG. 2 is an exploded perspective view showing the rearward side of the connector device of FIG. 1.
Figure 3:
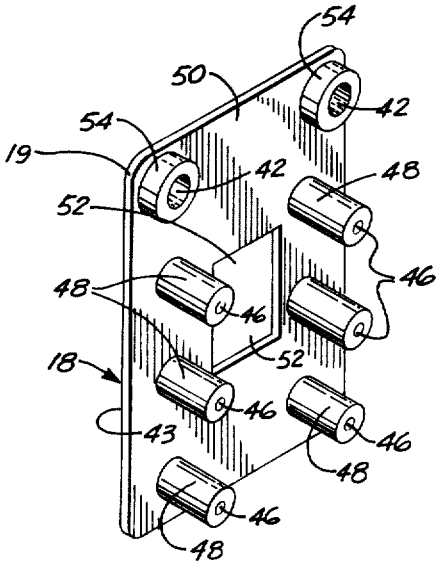
FIG. 3 is a perspective view of the terminal board of FIG. 2 showing the supports.

FIGS. 1–3 illustrate one preferred embodiment of a connector device of the present invention, generally indicated at 10. The device 10 includes a cover plate 12, at least one receptacle 14, and a terminal board 18. The connector device 10 is used as a connector in a communication system providing conductive connection to communication lines within a wall, panel board or communication equipment. The communication equipment includes vocal communication equipment such as telephones and telephone answering machines and includes machine to machine communication equipment, such as computer to computer communication.

The connector device 10 is mounted flush against an outer surface 16. The outer surface 16 is part of a conventional wall, or a wall of a panel board or, communication equipment. The connector device receives at least one electrical communication plug (not shown) and conductively connects the plug with the communication lines. The electrical communication plug (not shown) is a conventional electrical communication plug that is conductively connected to and is used to connect communication equipment, such as the equipment described above. A typical example of the plug contemplated is shown in the Hughes Patent et al U.S. Pat. No. 4,221,458.

More specifically, the cover plate 12 has a front side 20 and a rear side 22. The rear side 22 has a peripheral flange 24. The front side 20 faces outwardly, covering a cavity 23 (usually an electrical box) from view and has a generally attractive appearance. The cover plate 12 has an opening 26 having a configuration conforming to the contour of the plug used. Preferably, a plurality of screw apertures 28 extend through the cover plate 12. Screws 29 extend through the apertures 28 and threadably engage corresponding threaded holes (not shown). The threaded holes (not shown) are located either in the surface 16 or in an electrical box (not shown) beneath the surface in the cavity 23 holding the cover plate 12 flush against the outer surface 16.

The receptacle 14 is positioned on the rear side 22 of the cover plate 12 and is preferably attached to the rear side 22. The receptacle 14 is a conventional communication receptacle and a typical example is described in the Hughes et al patent. An insulated housing 30 has a plug receiving end 32, defining an interior cavity with a plurality of spring-type contacts 34 for conductive contact with corresponding conductive connectors in a mating plug. The plug receiving end 32 is aligned with the opening 26 of the cover plate 12 to allow the communication plug to be inserted into the plug receiving end. The plug receiving end 32 is also preferably aligned substantially in the same plane as the cover plate 12. A rearward end 36 of the housing 30 extends into the cavity 23 when the cover plate 12 is mounted flush against the surface 16. A plurality of wires 38 extend from the rearward end 36 of the receptacle 14 and are conductively connected within the receptacle to the spring-type contacts 34.

The terminal board 18 has a base 19 and is preferably attached to the rear side 22 and has a plurality of terminal screws 40, 41 located on backside 43. Other types of terminals are also within the scope of the present invention. The terminal board 18 is preferably attached by the terminal screws 40 to posts 44 on the rear side of 22. The terminal screws 40 extend through apertures 42 in the base 19 and threadably engage threaded holes 56 in the posts 44. However, terminal board 18 can be attached to the cover plate 12 by any conventional method. The terminal screws 40, 41, are made of a conventional conductive material.

The terminal screws 41 threadably engage a plurality of threaded holes 46, each located in a spacer post 48. The spacer posts 48 are positioned on a front side 50 of the base 19 of board 18 which faces the rear side 22 of the cover plate 12. The spacer posts 48 space the terminal board 18 from the rear side 22 such that the front side 50 is supported by the posts 48 spaced from the rear side 22. The spacer posts 48 allow sufficient mounting space for the receptacle 14. An opening 52 in the base 19 is positioned to allow the wires 38 to extend therethrough for conductive connection to the terminal screws 40, 41 on the back side 43.

The apertures 42 extend through the base 19 into the posts 54 and have a larger diameter in the posts 54 than in the base 19 so the posts 54 slip over the posts 44 and the screws 40 threadably engaging the aperture 56 in the posts 44 to hold the terminal board in place.

Each wire 38 is preferably conductively connected to an electrical connector 60. The wires 38 extend through the aperture 52 in the base 19 and are fastened to the terminal screws 40. 41. Communication wires (not shown) connected to the communication system (not shown) are conductively connected to the terminal screws 40, 41, conductively connecting the communication system. A location 61 for a resistor if needed is included preferably on the back side 43 between the terminal screws 40.

Figure 4:
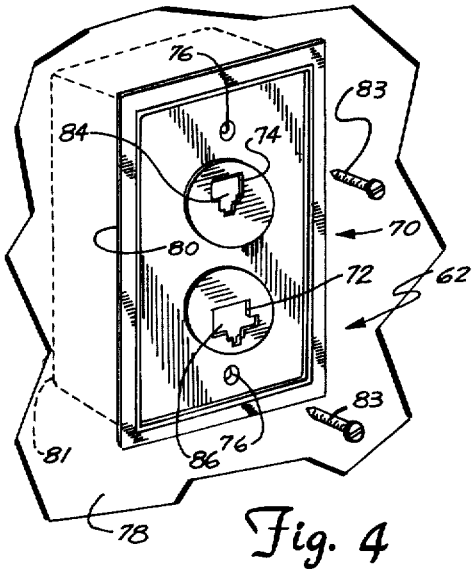
FIG. 4 is a perspective view of another embodiment of the present invention having two receptacles.
Figure 5:
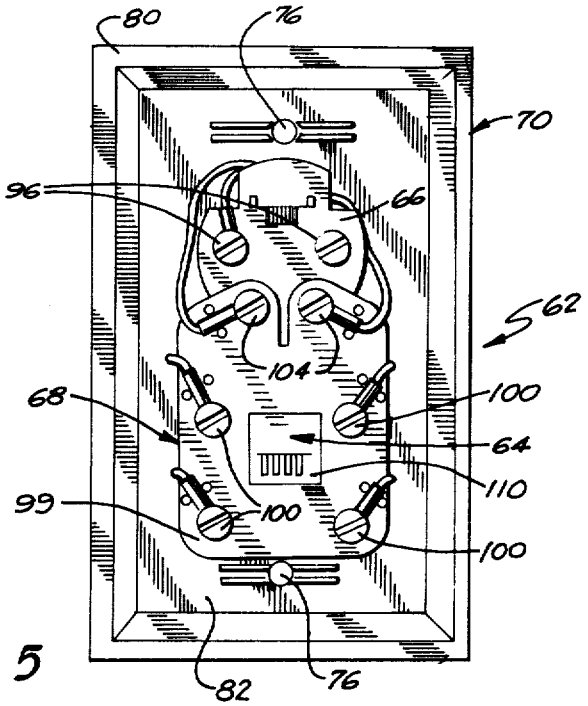
FIG. 5 is a rear elevational view of the connector device in FIG. 4.
Figure 6:
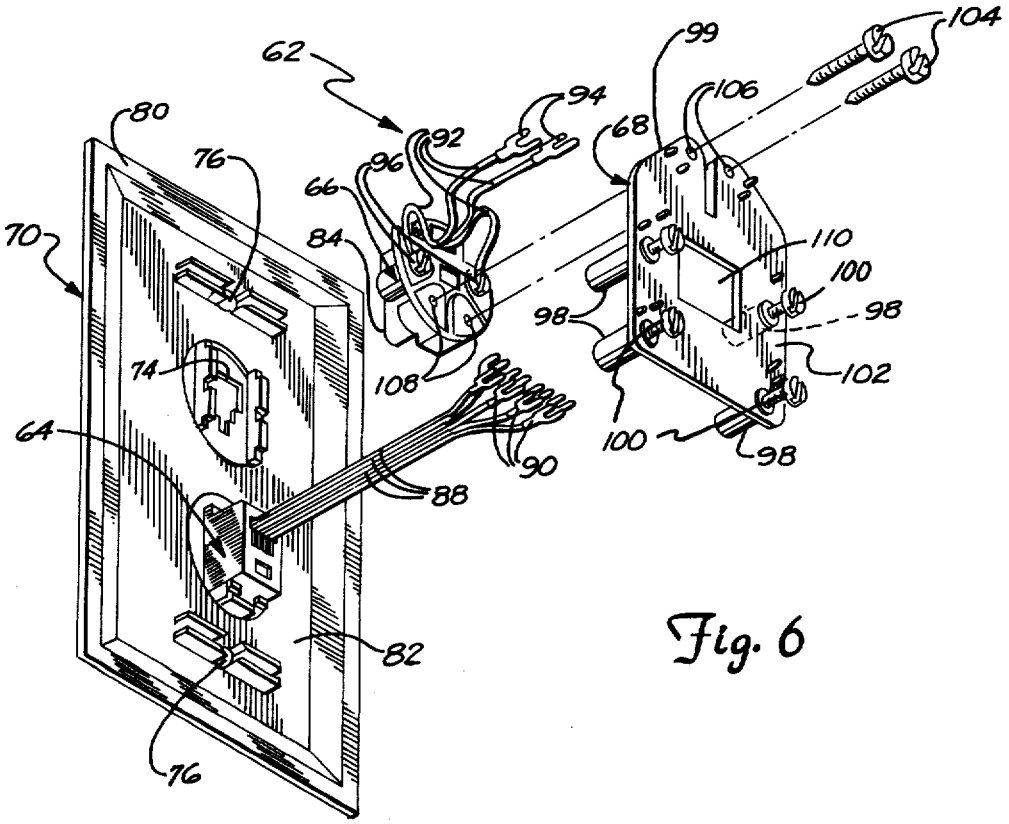
FIG. 6 is an exploded perspective view of the rearward side of the connector device shown in FIGS. 4 and 5.

Another embodiment of the present invention generally indicated at 62 is shown in FIGS. 4–6. The embodiment 62 is similar to the one shown in FIGS. 1–3 and has two plug receptacles 64, 66 with a terminal board 68 fastened to the receptacle 66. As seen from the figures, the device of the present invention also includes a plurality of receptacles attached to a cover plate 70.

In more specific detail, the cover plate 70 has openings 72, 74 both having a configuration conforming to the contour of a particular communication plug (not shown) which is conductively connected to a piece of communication equipment. Each receptacle 64, 66 is aligned in the same manner as the receptacle 14 with the corresponding opening 72, 74. The cover plate 70 also preferably has a plurality of apertures 76 through which a plurality of screws 83 are inserted for fastening the cover plate 70 to a surface 78 of a wall or to an electrical box (not shown). The cover plate 70 adjacently abuts against the surface 78. The cover plate 70 has an outer periphery 80 on a rear side 82 which adjacently abuts the wall 78 when the cover plate is mounted flush by the screws 83 against the surface 78 as previously described.

The receptacle 66 has a plug receiving end 84 for receiving the corresponding communication plug (not shown). The receptacle 66 is attached to the rear side 82 of the face plate 70 such that the plug receiving end 84 is aligned with the opening 74 in the face plate 70. Likewise, the receptacle 64 has a plug receiving end 86 for receiving the corresponding communication plug (not shown) and is aligned with an opening 74 permitting the receptacle 64 to receive the communication plug (not shown).

The receptacles 64, 66 are similar to the receptacle 14 previously discussed above. The receptacle 64 includes a housing and has a plurality of conductive wires 88, each wire 88 being conductively connected to an electrical connector 90 at a free end and being conductively connected at the other end within the receptacle 64 to spring-type contacts (not shown) which engage the communication plug (not shown) when inserted into the plug receiving end 86. The receptacle 66 also includes a housing and has a plurality of wires 92 with their free ends being conductively connected to electrical connectors 94, and the other ends, similarly being connected to spring-type contacts (not shown) within the receptacle 66. Receptacle 66 further preferably includes a plurality of terminal screws 96 which act as conductive terminals.

The terminal board 68 has a plurality of spacer posts 98 on a base 99 for spatially separating and supporting the terminal board 68 from the rear side 82 of the cover plate 70. The spacer posts also preferably receive and threadably engage terminal screws 100 which serve as conductive terminals on a backside 102 of the base 99. A plurality of terminal screws 104 extend through a plurality of apertures 106 in the base 99 and extend into a plurality of threaded apertures 108 located in a rearward end of the receptacle 66. The terminal screws 104 threadably engage and retain the terminal board in position on the rear side 83 of the cover plate 70 by attaching the terminal board 68 to the rearward end of the receptacle housing. Alternatively, the terminal board 68 can be attached to any receptacle housing that is attached to the cover plate 70. A plurality of wires 88 conductively connected to the receptacle 64 extend through an aperture 110 in the base 99 and are conductively connected to the terminal screws 96, 100 or 104, acting as conductive terminals, as shown in FIG. 5. A plurality of wires (not shown) conductively connected to a communication system (not shown) are conductively connected to the terminal screws 96, 100, 104 to complete conductive connection of the connector device 62 to the communication system.

In use, the device of the present invention as illustrated in the Figures provides a plurality of terminals on a terminal board attached to the rear side of the face plate. The wires which are conductively connected to the communication system are simply attached to the terminals located on the back side of the base of the terminal board. The cover plate is then attached by screws to the surface of the wall or to the electrical box in a cavity and is positioned flush against the surface of the wall hiding the cavity that the receptacles are being simultaneously inserted into. The device of the present invention eliminates the need of separately attaching the receptacle and cover plate and aligning both with respect to each other during installation. More importantly, more complex type contacts which receive more complex communication plugs having a greater number of conductive connectors are easily accommodated by the connector device of the present invention. Such receptacles and communication plugs are of great value in complex phone systems and computer connections.

It should be understood that the above described embodiments are only illustrative of the quantity of the receptacles and the terminal boards that are within the scope of the present invention. The connector device of the present invention includes greater quantities of receptacles and terminal boards than illustrated in the Figures.

In addition, persons skilled in the art will recognize that changes may be made in form and detail with respect to the cover plate, receptacle, and terminal board without departing from the spirit and scope of the present invention.

What is claimed is:

1. A connector device for receiving an electrical communication plug and which mounts flush on a surface having a cavity therein and with a rear side facing the cavity, the device comprising:

a cover plate having at least one opening therethrough and a periphery circumscribing a rear side for adjacently abutting the surface;

means for attaching the cover plate to the surface;

at least one housing having a receptacle defined therein attached to the cover plate, said housing having a plug receiving end and a rearward end, the plug receiving end being aligned with the opening of the cover plate for cooperation therewith and the rearward end extending into the cavity, the receptacle having first conductive means for conductively contacting the communication plug inserted into the plug receiving end and a second conductive means conductively connected to the first conductive means; and a terminal board positioned on the rear side of the cover plate having a base with a plurality of conductive terminals on the base conductively connected to the second conductive means, and having a plurality of supports projecting from the base toward the cover plate supporting the base from the rearside of the cover plate, and wherein said base is fastened with respect to the cover plate with threaded fasteners substantially less in number than the number of terminals and wherein at least one of the conductive terminals is a threaded fastener that threadably fastens the base to the rearward end of the receptacle.

2. The device of claim 1 wherein at least one of the conductive terminals is a threaded fastener that threadably fastens the base directly to the rear side of the cover plate.

3. The device of claim 1 wherein there are a plurality of receptacles and a plurality of corresponding openings within the cover plate, each receptacle being aligned with an opening and attaching to the rear side of the cover plate.

4. The device of claim 1 wherein the first conductive means is a plurality of spaced apart spring-type contacts for conductive contact with the communication plug.

5. The device of claim 4 wherein the second conductive means is a plurality of conductive wires.

6. The device of claim 1 wherein the terminal board comprises a flat board, said supports comprising a plurality of posts fixed to the board and having outer ends lying along a common plane, one end portion of the flat board having means defining a support plane substantially toward the flat board from the common plane said means defining being adapted to be fastened with respect to portions of the cover plate with the support posts supported on other portions of the cover plate.

7. The device of claim 6 wherein the flat board is fastened with respect to the cover plate through the housing and said means defining resting on portions of the housing and being fastened with respect to the housing.

8. A connector device for receiving an electrical communication plug and which mounts flush on a surface having a cavity therein and with a rear side facing the cavity, the device comprising:

a cover plate having at least one opening therethrough and a periphery circumscribing a rear side for adjacently abutting the surface;

means for attaching the cover plate to the surface;

at least one housing having a receptacle defined therein attached to the cover plate, said housing having a plug receiving end and a rearward end, the plug receiving end being aligned with the opening of the cover plate for cooperation therewith and the rearward end extending into the cavity, the receptacle having first conductive means for conductively contacting the communication plug inserted into the plug receiving end and a second conductive means conductively connected to the first conductive means; and a terminal board positioned on the rear side of the cover plate having a base with a plurality of conductive terminals on the base conductively connected to the second conductive means and wherein at least one of the conductive terminals is a threaded fastener that threadably fastens the base directly to the rear side of the cover plate, and having a plurality of supports projecting from the base toward the cover plate supporting the base from the rearside of the cover plate.

9. A connector device for receiving an electrical communication plug and which mounts flush on a surface having a cavity therein and with a rear side facing the cavity, the device comprising:

a cover plate having a least one opening therethrough and a periphery circumscribing a rear side for adjacently abutting the surface;

means for attaching the cover plate to the surface;

at least one housing having a receptacle defined therein attached to the cover plate, said housing having a plug receiving end and a rearward end, the plug receiving end being aligned with the opening of the cover plate for cooperation therewith and the rearward end extending into the cavity, the receptacle having first conductive means for conductively contacting the communication plug inserted into the plug receiving end and a second conductive means conductively connected to the first conductive means; and a terminal board positioned on the rear side of the cover plate having a base with a plurality of conductive terminals on the base conductively connected to the second conductive means, and having a plurality of supports projecting from the base toward the cover plate supporting the base from the rearside of the cover plate, and wherein the terminal board comprises a flat board, said supports comprising a plurality of posts fixed to the board and having outer ends lying along a common plane, one end portion of the flat board having means defining a support plane substantially spaced toward the flat board from the common plane, said means defining being adapted to be fastened with respect to portions of the cover plate with the support posts supported on other portions of the cover plate.

10. The device of claim 9 wherein the flat board is fastened with respect to the cover plate through the housing and said means defining resting on portions of the housing and being fastened with respect to the housing.

* * * * *